US005368969A

United States Patent [19]

Yoshikawa et al.

[11] Patent Number: 5,368,969

[45] Date of Patent: Nov. 29, 1994

[54] COATING AGENT FOR ELECTROPHOTOGRAPHIC CARRIER AND CARRIER COATED THEREWITH

[75] Inventors: Yuji Yoshikawa, Annaka; Mitsuhiro Takarada, Takasaki, both of Japan

[73] Assignee: Shin-Etsu Chemical Co., Ltd., Tokyo, Japan

[21] Appl. No.: 16,273

[22] Filed: Feb. 11, 1993

[30] Foreign Application Priority Data

Feb. 14, 1992 [JP] Japan ..... 4-059779

[51] Int. Cl.[5] ..... G03G 9/00

[52] U.S. Cl. ..... 430/108; 430/110

[58] Field of Search ..... 430/108, 110; 525/479

[56] References Cited

U.S. PATENT DOCUMENTS

| | | | |
|---|---|---|---|
| 4,277,595 | 7/1981 | Deichert et al. | 525/479 |
| 4,977,054 | 12/1990 | Honjo et al. | 430/108 |

FOREIGN PATENT DOCUMENTS

| | | |
|---|---|---|
| 54-21730 | 2/1979 | Japan . |
| 59-26945 | 10/1980 | Japan . |
| 58-40557 | 3/1983 | Japan . |
| 59-131933 | 8/1983 | Japan . |
| 59-53875 | 3/1984 | Japan . |
| 60-59369 | 4/1985 | Japan . |
| 167151 | 1/1990 | Japan . |
| 2-73372 | 3/1990 | Japan . |
| 2-103563 | 4/1990 | Japan . |

*Primary Examiner*—Steve Rosasco

*Attorney, Agent, or Firm*—Finnegan, Henderson, Farabow, Garrett & Dunner

[57] ABSTRACT

The present invention provides a coating agent for an electrophotographic carrier comprising as a major component a copolymer of at least one monomer selected from the organopolysiloxanes represented by the following general formulas 1, 2, and 3 with other polymerizable monomer:

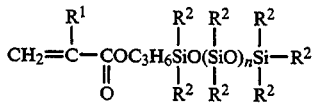

(1)

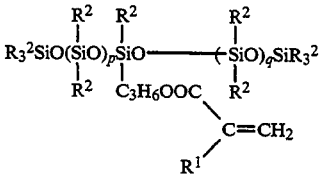

(2)

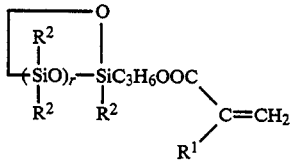

(3)

wherein the general formulas 1, 2, and 3, $R^1$ is hydrogen atom or methyl group; $R^2$ is $C_1$–$C_{10}$ alkyl or phenyl group; $R^3$ is $R^2$ or $CH_2{=}C(R^1)COOC_3H_6$; n, p, and q are defined as $n \geqq 3$, $p \geqq 0$, $q \geqq 3$, and $p < q$; and r is an integer of 2–20.

The coating agent for an electrophotographic carrier resists the formation of wear, peeling, cracks, and the like, which can also prevent the spent condition from occurring and thus, permits use over a long period of time; and it provides a long-life electrophotographic carrier in which the carrier charge characteristics exhibit low temperature dependency.

2 Claims, No Drawings

COATING AGENT FOR ELECTROPHOTOGRAPHIC CARRIER AND CARRIER COATED THEREWITH

BACKGROUND OF THE INVENTION

The present invention relates to an electrophotographic carrier coating agent, in particular a coating agent for use in an electrophotographic carrier which exhibits excellent copying durability and an electrophotographic carrier, the nuclear surface of which is coated therewith.

It is known that the developer for a two-component dry type copier comprises two components, a minute toner and carrier particles which are larger than the toner, where mixing and agitating the two generates friction, which electrostatically charges the toner and carrier to different polarities. The resultant charged toner, when electrostatically adhered to an electrostatic latent image generated on a photoreceptor, generates a visible image; the image is then transferred to and fixed on a transfer sheet to complete the copying operation.

The carrier is normally an oxidized or nonoxidized iron powder. If it is used unmodified with the toner, this results in insufficient triboelectric charge characteristics for the toner, in addition, it results in the toner being bound to the carrier surface during use so as to generate a toner-covered film (spent condition), thereby changing the charge characteristics of the carrier over a period of time and eventually shortening the lifetime of the developer.

An additional shortcoming has been that the difference in carrier charge characteristics between dry and wet environments is large. Therefore, it is customary for the prevention of these drawbacks to coat the carrier surface with resins, such as fluororesins, acrylic resins, styrene-acrylic copolymers, silicone resins, polyester resins, and the like.

However, coating with a hydroxyl-containing polyester resin or an acrylic resin, or the like, has been deficient in that the method requires crosslinking with an isocyanate or melamine, or the like (Japanese Patent Kokai Publications Sho. 59-53875 and Sho. 60-59369), so that unless crosslinking was complete, the unreacted hydroxyl or isocyanate groups tended to remain, adversely affecting the charge characteristics.

Coatings with acrylic resins, styrene-acrylic copolymers, or the like, have been deficient also in that while initial charge characteristics were excellent, the brittle coated films decreased the durability.

On the other hand, fluororesins, silicone resins, etc., have drawn attention because the low surface energies of these resins can reduce the spent condition (Japanese Patent Kokai Publications Sho. 54-21730 and Sho. 58-40557; Japanese Patent Kokoku Publications Sho. 59-26945 and Sho. 59-131944).

Silicone resins provide a number of working advantages in that monomer selection can provide a variety of molecular structures, which gives the advantage of being able to generate carriers with a variety of static charge levels; solubility in a variety of solvents permits a uniform coating over the carrier surface; and curing is possible even at relatively moderate temperatures, etc.

However, silicone resins, in general, are deficient in mechanical strength, though not as bad as with acrylic resins, so that they tend to generate wear, peeling, cracks, and the like, after use over a long period of time, thereby sloughing-off the surface of the carrier and thus, losing their excellent properties and adversely affecting the copying capabilities, so that they have never been completely satisfactory in terms of a long-term use service life.

A long-term service life coating agent has been disclosed in the past (Japanese Patent Kokai Publications Hei. 2-73372 and Hei. 2-103563), but as yet there have been none with silicone-modified acrylic resins.

SUMMARY OF THE INVENTION

Thus, the first object of the present invention is to provide a carrier coating agent for an electrophotographic carrier which resists the formation of wear, peeling, cracks, and the like, which can also prevent the spent condition from occurring and thus, permits use over a long period of time.

The second object of the present invention is to provide a coating agent for a long-life electrophotographic carrier in which the carrier charge characteristics exhibit low temperature dependency.

The present inventors have made intensive investigation and have discovered that introducing siloxane chains into an acrylic resin, both for the purpose of taking advantage of the excellent charge characteristics of acrylic resins and the advantages in lubrication, peel, water repellency with siloxane chains, resulted in not only showing the expected results, but also suppressing the spent condition, so as to extend the lifetime of the developer, as well as decreasing the temperature dependency of the carrier charge characteristics, which led to the present invention.

The above objects of the present invention are met by an electrophotographic carrier coating agent comprising as a main component a copolymer of at least one monomer selected from organopolysiloxanes represented by the following general formulas 1, 2, and 3 with other polymerizable monomer.

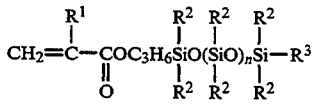

(1)

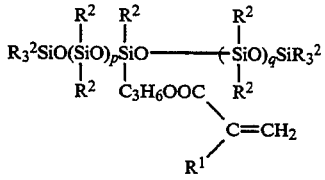

(2)

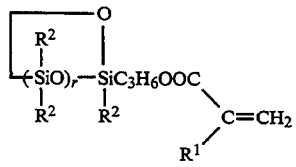

(3)

In general formulas 1, 2, and 3, $R^1$ is hydrogen atom or methyl group; $R^2$ is $C_1$–$C_{10}$ alkyl or phenyl group; $R^3$ is $R^2$ or $CH_2{=}C(R^1)COOC_3H_6$; n, p, and q are defined as $n \geqq 3$, $p \geqq 0$, $q \geqq 3$, and $p < q$; and r is an integer of 2–20.

DETAILED DESCRIPTION OF THE PREFERRED EMBODIMENTS

Organopolysiloxanes represented by general formula 1 above are silicone oils with an acrylic-modified or methacrylic-modified terminus or termini. It is particularly preferred for n to be at least 3 to take full advantage of silicone oil. In particular, $R^2$ is preferably a methyl group from the industrial standpoint.

There is no particular limitation as to the method of synthesizing a silicone oil with a (meth)acrylic modified terminus, but a typical method calls for mixing a compound with one terminal silanol group which can be synthesized by ring-opening polymerization of hexamethyl cyclotrisiloxane represented by general formula 4 in the presence of trimethyl silanol $(CH_3)_3SiOH$ with the use of a pentavalent silicon complex catalyst, with an equimolar amount of gamma-methacryloxypropyl dimethylchlorosilane represented by general formula 5, and then carrying out dehydrochlorination in the presence of a hydrogen chloride trap, such as a tertiary amine compound, or the like.

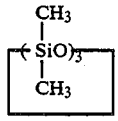

(4)

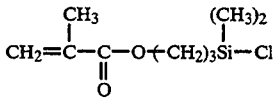

(5)

There is also no particular limitation as to the method for synthesizing a silicone oil with both termini modified with (meth)acrylics, but a typical method calls for equilibrating a hydrolysis product of gamma-methacryloxypropyl dimethylchlorosilane with dimethyl siloxane represented by the following general formula 6 in the presence of an acid catalyst, or adding allyl methacrylate to an alpha, omega-hydrodiene polysiloxane in the presence of a platinum catalyst, or the like.

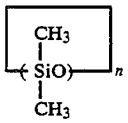

(6)

An organopolysiloxane represented by general formula 2 is a side chain (meth)acrylic modified silicone oil, where p+q is preferably 3 or higher in order to take full advantage of the characteristics of silicone oil. From the industrial standpoint, $R^2$ is preferably methyl or phenyl.

There is no particular limitation as to the method for synthesizing an organopolysiloxane represented by general formula 2; a typical method calls for mixing 2 moles of a compound with one silanol terminus which can be synthesized by ring-opening polymerization of hexamethyl cyclotrisiloxane represented by general formula 4 in the presence of trimethyl silanol $(CH_3)_3SiOH$ in the presence of a pentavalent silicon complex catalyst, with one mole of gamma-methacryloxypropyl methyldichlorosilane represented by the following general formula 7 and carrying out dehydrochlorination reaction in the presence of a hydrogen chloride trap, such as a tertiary amine, or the like.

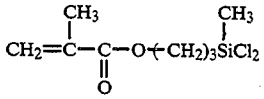

(7)

In addition, the above can also be prepared by adding allyl (meth)acrylate, in the presence of a platinum catalyst to a hydrodiene polysiloxane having one hydrogen group in its pendent chain.

In all of the organopolysiloxanes of general formulas 1–3, the silicone oil segments introduced into the acrylic resin contributes to improved lubrication and peel properties to give good performance.

A siloxane represented by general formula 3 can be readily obtained by a partial addition reaction of r moles of an alkene to a cyclic organo-hydrodiene siloxane represented by general formula 8, followed by adding one mole of allyl(meth)acrylate in the presence of a platinum catalyst.

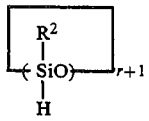

(8)

The preferred r value is 2–20, particularly a mixture of 3–20.

The polymerizable monomers used for copolymerization with at least one type of organopolysiloxanes selected from the organopolysiloxanes represented by general formulas 1–3 include methyl acrylate, methyl methacrylate, cyclohexyl methacrylate, 2-ethylhexyl acrylate, 2-ethylhexyl methacrylate, 2-hydroxyethyl acrylate, 2-hydroxyethyl methacrylate, styrene, alpha-methyl styrene, n-butyl acrylate, methyl vinyl ether, ethyl vinyl ether, isopropyl vinyl ether, 2-hydroxypropyl acrylate, 2-hydroxypropyl methacrylate, cyclohexyl vinyl ether, vinyl acetate, vinyl benzoate, acrylic acid, methacrylic acid, maleic acid, maleic anhydride, and the like.

These polymerizable monomers are preferably used in amounts of 5–100 parts by weight, particularly 10–40 parts by weight per 10 parts by weight of the organopolysiloxane. Use of less than 5 parts by weight adversely affects the drying capability, while an amount greater than 100 parts by weight adversely affects the characteristics of silicone, such as lubrication properties, and the like.

The (meth)acrylic-type polymerization is carried out by a conventional method, for example, by a solution polymerization in which a (meth)acrylic monomer is added dropwise for polymerization in the presence of a diazo compound, such as 2,2'-azobisisobutyronitrile catalyst, or the like, or an organic peroxide under a toluene reflux condition.

The (meth)acrylic polymer synthesized by this method has a molecular weight of about 50,000–100,000, which in this invention is preferably 10,000–1 million. The present invention can also be carried out by copolymerizing a (meth)acrylic compound containing a hydrolyzable silyl-group, as part of the (meth)acrylic monomer component, with at least one selected from the organopolysiloxanes of general formulas 1–3. Thus the coating agent of this invention can be cured in the presence of a moisture-curable catalyst.

That is, the alkoxyl group hydrolyzes with the adsorbed water on a carrier unclear particle followed by curing, which futher improves the adhesion of the coating agent to the carrier nuclear particle, as well as further improving the mechanical strength by siloxane crosslinking.

Preferably, the above hydrolyzable-silyl-containing (meth)acrylic compound is a type represented, particularly by the following general formula 9.

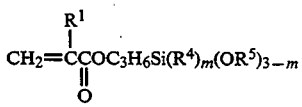

(9)

wherein $R^1$ is hydrogen atom or methyl group; $R^4$ and $R^5$ are $C_1$–$C_{10}$ alkyl group; m is an integer of 0–2.

Specific examples for hydrolyzable-silyl-containing (meth)acrylic compounds represented by general formula 9 include gamma-methacryloxypropyl trimethoxysilane, gamma-acryloxypropyl trimethoxysilane, gamma-methacryloxypropyl methyldimethoxysilane, gamma-methacryloxypropyl dimethylmethoxysilane, and the like.

Preferably, the amount of hydrolyzable-silyl-containing (meth)acrylic compound is 0.5–10 parts by weight per 10 parts by weight of the (meth)acrylic monomer. The use of less than 0.5 parts by weight provides an insufficient moisture-curable function, while the use of more than 10 parts by weight adversely affects the storage stability of the copolymer.

The moisture curable catalysts include dibutyltin diacetate, dibutyltin dioctoate, dibutyltin dilaurate, tetraisopropyl titanate, tetrabutyl titanate, gamma-aminopropyl triethoxysilane, N-(beta-aminoethyl)aminopropyl trimethoxysilane, and the like. These catalysts are preferably used in amounts of 0.05–5.0% by weight per resin solids.

The carrier nuclear particles used in this invention are typically steel and ferrite powders, being suitably selected from those known in the art as carrier nuclear particle materials, such as magnetic materials, such as nickel, cobalt, and the like, or their oxides, copper, carborundum, glass beads, silicon dioxide, and the like.

The carrier nuclear particle has a particle size of 10–1,000 microns, preferably 50–300 microns.

This invention calls for, optionally, dissolving an acrylic resin comprising the above materials in an organic solvent (hydrocarbon type solvents, such as toluene, xylene, solvent ligroin, and the like, alcohols, esters, and the like), followed by coating onto carrier nuclear particles by means of a fluidized bed method, impregnation, spraying, and the like, followed by drying and curing.

The film thickness of the coated film is preferably 0.1–20 microns. Optionally, multiple coatings are possible. Depending on the objective, a multiple number of coats may be given with each layer having different components.

The silicone composition of this invention is curable at ambient temperature, but curing by heating to about 100°–250° C. is preferred because of the stabilization of the coated film characteristics and increased production rate.

There is no particular limitation as to the toner used with the carrier used in the developer, and use can be made of a broad range of materials such as natural resin, a combination of natural and synthetic resins, in which a variety of known synthetic dyes are dispersed.

As described above in detail, the coating agent for an electrophotographic carrier of this invention, in addition to providing the characteristics of siloxane chains in terms of lubrication, peel and water repellency properties, exhibits the excellent charge characteristics of the acrylic resin so that there are no phenomena of wear or peeling by the mutual collision of carriers; in addition, the spent condition can also be suppressed, so that this invention is particularly effective as a coating agent for an electrophotographic carrier. The present invention also gives an advantage in that the carrier using the coating agent of this invention gives a low temperature dependency of the charge characteristics.

EXAMPLES

The present invention is further described in detail by the following examples, which however, do not limit the scope of this invention.

Synthetic Example 1

30 parts by weight of the organopolysiloxane represented by the following general formula 10, 20 parts by weight of n-butyl acrylate, 50 parts by weight of methyl methacrylate, and 2 parts by weight of 2,2'-azobisisobutyronitrile were placed in a dropping funnel and the mixture solution was added dropwise into 60 parts by weight of refluxing toluene over a period of 3 hours.

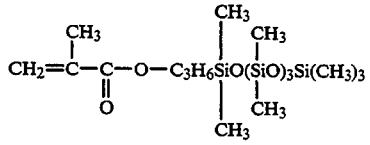

(10)

After one hour of refluxing, 40 parts by weight of toluene containing 0.5 parts by weight 2,2'-azobisisobutyronitrile was added followed by further refluxing 4 hours to obtain acrylic resin A.

Synthetic Example 2

30 parts by weight of the organopolysiloxane represented by general formula 10, 12 parts by weight of n-butyl acrylate, 50 parts by weight of methyl methacrylate, 8 parts by weight of the organo silane represented by general formula 11, and 2 parts by weight of 2,2'-azobisisobutyronitrile were charged in a dropping funnel, otherwise followed by repeating Synthetic Example 1 to carry out polymerization and adding 0.5 parts by weight of dibutyltin dioctoate to obtain acrylic resin B.

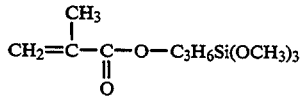

(11)

Synthetic Example 3

Acrylic resin C was obtained by repeating Synthetic Example 2 except for replacing the organopolysiloxane of general formula 10 with the compound of general formula 12.

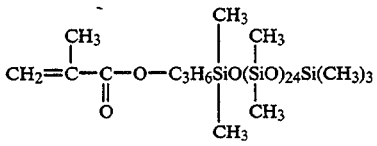

(12)

Synthetic Example 4

Acrylic resin D was obtained by repeating Synthetic Example 2 except for replacing 10 parts by weight of the 30 parts by weight of the organopolysiloxane of general formula 10 with 10 parts by weight of the organopolysiloxane represented by the following general formula 13.

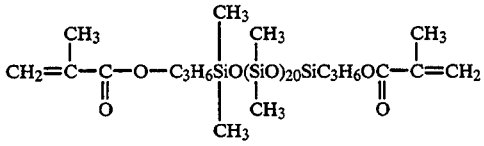

(13)

Synthetic Example 5

Acrylic resin E was obtained by repeating Synthetic Example 2 except for replacing 10 parts by weight of the 30 parts by weight of the organopolysiloxane of general formula 10 with 10 parts by weight of the organopolysiloxane represented by general formula 14.

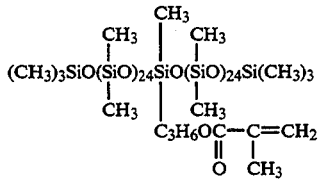

(14)

Control Example 1

Acrylic resin X was obtained by repeating Synthetic Example 1 except for charging in the dropping funnel 30 parts by weight of n-butyl acrylate, 60 parts by weight of methyl methacrylate, 10 parts by weight of styrene, and 2 parts by weight of 2,2'-azobisisobutyronitrile.

Examples 1–5 and Control Example 1

The above acrylic resins A~E, and X were diluted with toluene to give 10% solutions. Ferrite with an average particle size of 100 microns, as carrier nuclear particles, was sprayed with the above silicone coating at a rate of 20 g/kg in a fluidized bed apparatus (Spiral-Flow-Mini: produced by Frointo Sangyo K.K., tradename), followed by heating 10 minutes at 150° C. to cure the silicone component.

30 g of the above-treated carrier powder was shaken with 0.15 g of negatively-charged silica (R-972: produced by Nippon Aerosil K.K., tradename) for electrostatically charging, followed by measuring the amount of charge on the toner by a blow-off powder charge measurement apparatus, a product of Toshiba Chemical K.K.

Then, 1 kg of a carrier and 5 g of the negatively-charged silica (R-972) were placed in a 500 ml porcelain accelerated charge decay apparatus, followed by vigorously shaking at a rate of 370 reciprocal motions per minute at a horizontal amplitude width of 4 cm for carrying out an accelerated decay test. A 30-minute cycle by this accelerated decay test is equivalent to approximately 5,000 sheets copied by a commercial copier. The test results are given in Table 1.

TABLE 1

| | Acrylic Resin | Initial Charge (μc/g) | Amount Charged (μc/g) (After 10 Hours Accelerated Decay Test) |
|---|---|---|---|
| Example 1 | A | 43.2 | 31.1 |
| Example 2 | B | 39.7 | 30.6 |
| Example 3 | C | 35.8 | 29.8 |
| Example 4 | D | 37.1 | 29.5 |
| Example 5 | E | 35.1 | 28.9 |
| Control Example 1 | X | 45.7 | 18.5 |

Table 1 demonstrates that acrylic resin X, which is free of silicone oil, shows extensive decay in the amount charged and is not usable as a developer, while copolymerized acrylic resins A–E of the present invention having silicone-oil chains maintain satisfactory levels even after accelerated decay.

In addition, a comparison of B with C shows that one with a longer silicone-oil chain undergoes less decay, proving that silicone-oil chains are effective for improving flow characteristics and durability.

We claim:

1. A coating agent for an electrophotographic carrier comprising as a major component a copolymer of at least one monomer selected from the organopolysiloxanes represented by the following formulas 1, 2, and 3 with another polymerizable monomer:

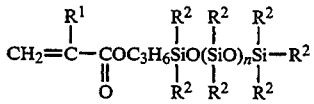

(1)

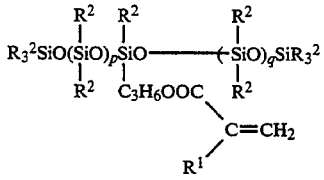

(2)

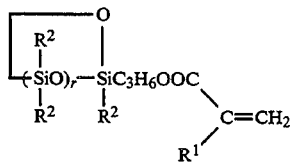

(3)

wherein in the formulas 1, 2, and 3, $R^1$ is a hydrogen atom or methyl group; $R^2$ is $C_1$–$C_{10}$ alkyl or phenyl group; n, p, and q are defined as $n \geqq 3$, $p \geqq 0$, $q \geqq 3$, and $p < q$; and r is an integer of 2–20.

2. Electrophotographic carrier nuclear particles which are surface-coated with an electrophotographic carrier coating agent as claimed in claim 1.

* * * * *